US010231523B2

(12) United States Patent
Ni

(10) Patent No.: US 10,231,523 B2
(45) Date of Patent: Mar. 19, 2019

(54) INTELLIGENT ANTI-THEFT ZIPPER AND INTELLIGENT ANTI-THEFT SYSTEM FOR ZIPPERS

(71) Applicant: BAO LI ENTERPISE (HONG KONG) LIMITED, Hong Kong (CN)

(72) Inventor: Shiqiu Ni, Shenzhen (CN)

(73) Assignee: BAO LI ENTERPISE (HONG KONG) LIMITED, Hong Kong (CN)

( * ) Notice: Subject to any disclaimer, the term of this patent is extended or adjusted under 35 U.S.C. 154(b) by 0 days.

(21) Appl. No.: 15/515,603

(22) PCT Filed: Jun. 8, 2016

(86) PCT No.: PCT/CN2016/085330
§ 371 (c)(1),
(2) Date: Mar. 30, 2017

(87) PCT Pub. No.: WO2016/197954
PCT Pub. Date: Dec. 15, 2016

(65) Prior Publication Data

US 2018/0110309 A1 Apr. 26, 2018

(30) Foreign Application Priority Data

Jun. 10, 2015 (CN) ..... 2015 1 0317615

(51) Int. Cl.

| | |
|---|---|
| ***G08B 13/14*** | (2006.01) |
| ***A45C 13/10*** | (2006.01) |
| ***A44B 19/30*** | (2006.01) |
| ***A44B 19/24*** | (2006.01) |
| ***A45C 13/18*** | (2006.01) |

(52) U.S. Cl.
CPC ..... *A45C 13/10* (2013.01); *A44B 19/24* (2013.01); *A44B 19/301* (2013.01); *A45C 13/18* (2013.01); *G08B 13/14* (2013.01)

(58) Field of Classification Search
CPC ..... A45C 13/10; A45C 13/18; A44B 19/301; A44B 19/24
USPC ..... 340/571
See application file for complete search history.

(56) References Cited

FOREIGN PATENT DOCUMENTS

| | | | | |
|---|---|---|---|---|
| CN | 101079174 A | * | 11/2007 | ..... A44B 19/30 |
| CN | 103169203 A | * | 6/2013 | |
| CN | 103637412 A | * | 3/2014 | |

* cited by examiner

*Primary Examiner* — Tanmay K Shah

(57) ABSTRACT

An intelligent anti-theft zipper includes a zipper tape, a zipper head and an intelligent anti-theft module. The intelligent anti-theft module includes a control signal switch, an alarm unit and a power supply. The control signal switch includes a first switch component and a second switch component cooperating with each other. The first switch component is fixed on the zipper head; the second switch component is fixed on the zipper tape or an object mounted with the zipper, the installation position of the second switch component corresponds to the position of the zipper head when the zipper is fully closed. The control signal switch generates and outputs a control signal to the alarm unit to provide an alarm when the first switch component deviates from the second switch component for a predetermined distance.

13 Claims, 7 Drawing Sheets

INTELLIGENT ANTI-THEFT ZIPPER AND INTELLIGENT ANTI-THEFT SYSTEM FOR ZIPPERS

TECHNICAL FIELD OF THE INVENTION

The present disclosure relates to zipper field, and more specifically to an intelligent anti-theft zipper and an intelligent anti-theft system for zippers.

BACKGROUND OF THE INVENTION

Zippers as traditional closed connection accessories are widely used in cases, bags, clothing, tents, and other goods. A Current zipper mainly includes a left zipper tape, a right zipper tape, and a zipper head. The left and right zip tapes each includes a tape width and chain teeth stitched on the tape width. The zipper head includes a slider and a puller connected to the slider for pulling the slider. As the zippers have the characteristics of easy to being pulled, in order to improve the security of the zippers closing the cases or the bags, related manufacturers design zippers with locks. The zippers with locks mainly use pullers defining lock holes to cooperate with the locks mounted to the cases or bags, thereby locking the zipper heads in locking positions. The above-mentioned zippers can play a certain role in preventing illegal opening of the cases or the bags. However, in some zippers with long pullers, a small opening will be formed through facilitating lengths of the pullers to pull the zippers away for a distance, thus, there are still security risks. Moreover, the defects of being unable to promptly provide an alarm to timely inform the users still exists.

SUMMARY OF THE INVENTION

The present disclosure provides an intelligent anti-theft zipper which can timely detect the situation and provide an alarm when the zipper is illegally opened.

The present disclosure further provides an intelligent anti-theft system for zippers, which can timely detect the situation and provide an alarm in time when the zippers are illegally opened.

To resolve the above-mentioned technical problems, the present disclosure firstly provides an intelligent anti-theft zipper including a zipper tape, a zipper head, and an intelligent anti-theft module. The intelligent anti-theft module includes a control signal switch, an alarm unit for providing an alarm according to a control signal outputted from the control signal switch, and a power supply. The control signal switch includes a first switch component and a second switch component cooperating with each other. The first switch component is mounted to the zipper head, the second switch component is mounted to the zipper tape or an object mounted with the zipper. An installation position of the second switch component corresponds to a position of the zipper head in response to the zipper being completely closed. The control signal switch generates the control signal and transmits the control signal to the alarm unit in response to the first switch component deviating from the second switch component for a predetermined distance.

Furthermore, the zipper includes at least one group of zipper tapes and at least two zipper heads, each of the at least two zipper heads is mounted with one of the first switch component, and the zipper includes one of the second switch component; the one of the second switch component cooperates with the first switch components of the at least two zipper heads in an one-to-many control mode.

Furthermore, the alarm unit includes a wireless terminal component for outputting an alarm signal to an anti-theft terminal cooperating with the alarm unit.

Furthermore, the wireless terminal component is selected from the group consisting of a Bluetooth communication component, a 2.4G communication component, a GSM communication component, a GPRS communication component, and a 3G/4G/5G communication component.

Furthermore, the control signal switch is a proximity switch or a photo-electric switch.

Furthermore, the alarm unit includes an alarm device for providing an alarm, and the alarm device of the alarm unit includes at least one of a buzzer, a voice alarm, and a flash alarm.

Furthermore, the zipper further includes a puller locking device, wherein the puller locking device is mounted to the object mounted with the intelligent anti-theft zipper, and cooperates with a puller of the zipper head to lock the puller; the puller locking device is connected to the alarm unit, the puller locking device outputs a pause signal to the alarm unit to allow the alarm unit to enter a pause mode in response to the puller locking device being properly unlocked, the puller locking device outputs a start signal to the alarm unit to allow the alarm unit to enter an enabled mode in response to the puller locking device being locked.

Furthermore, the zipper tape includes a left zipper tape and a right zipper tape each including double-layered tape widths, each layer of the tape widths is formed with chain teeth; the zipper head includes a slider and a puller, the slider is double-layered, the left zipper tape includes a left tape width, and a left upper chain teeth and a left lower chain teeth respectively mounted to top and bottom surfaces of a right side of the left tape width; the right zipper tape includes a right tape width, and a right upper chain teeth and a right lower chain teeth respectively mounted to top and bottom surfaces of a left side of the right tape width; the left upper chain teeth cooperate with the right upper chain teeth, and the left lower chain teeth cooperate with the right lower chain teeth; the slider is a double-chained slider cooperating with a combination of the left upper chain teeth, the right upper chain teeth, the left lower chain teeth, and the right lower chain teeth.

Furthermore, the zipper tape includes a left zipper tape and a right zipper tape, the left and right zipper tapes each includes double-layered tape widths, and chain teeth are correspondingly mounted to each layer of the tape widths, the zipper head includes a double-layered slider and a puller, the double-layered slider includes a block and a double-layered lock connected to the block; the block includes a beam for mounting the puller, and a lock hole portion connected to the beam; the double-layered lock includes a pole, and a top plate, a middle plate, and a bottom plate parallel to one another and perpendicularly mounted to the pole.

The present disclosure also provides another intelligent anti-theft zipper including a zipper tape, a first zipper head and a second zipper head mounted to the zipper tape, and an intelligent anti-theft module, the intelligent anti-theft module includes a control signal switch, an alarm unit for providing an alarm according to a control signal outputted from the control signal switch, and a power supply, the control signal switch includes a first switch component mounted to the first zipper head, and a second switch component mounted to the second zipper head and cooperating with the first switch component, the control signal switch generates the control signal and transmits the control signal to the alarm unit in response to the first switch component deviating from the second switch component for a predetermined distance.

On the other hand, the present disclosure further provides an intelligent anti-theft system including an intelligent anti-theft zipper and an intelligent anti-theft terminal, wherein the intelligent anti-theft zipper is any one of the above-mentioned intelligent anti-theft zippers; the intelligent anti-theft terminal is connected to the alarm unit, and includes a terminal communication unit for communicating with the alarm unit, a signal processing unit for receiving and processing the alarm signal received by the terminal communication unit and then outputting an alarm command, and a terminal alarm unit for providing an alarm according to the alarm command.

Furthermore, the terminal communication unit of the anti-theft terminal is a wireless communication unit.

Furthermore, the anti-theft terminal is a smart phone, a tablet computer, or a special handheld alarm terminal.

After using the above-mentioned technical solutions, the present disclosure has at least the following advantageous effects. Through mounting the first switch component to the zipper head and mounting the second switch component to the zipper tape or the object mounted with the zipper, the control signal switch can generate and output the control signal to the alarm unit when the first switch component deviates from the second switch component for the predetermined distance. Therefore, the illegal opening of the zipper can be timely detected and an alarm can be timely provided, the anti-theft performance is effectively improved, and the cases, bags, clothing, tents, etc. that use the intelligent anti-theft zipper can obtain a better anti-theft safety performance.

DETAILED DESCRIPTION OF PREFERRED EMBODIMENTS OF THE INVENTION

It should be noted that, in the absence of conflict, the embodiments of the present disclosure may be combined with features illustrated in the embodiments. The present disclosure will now be described in further detail with reference to the accompanying drawings and specific examples.

Figure 1:
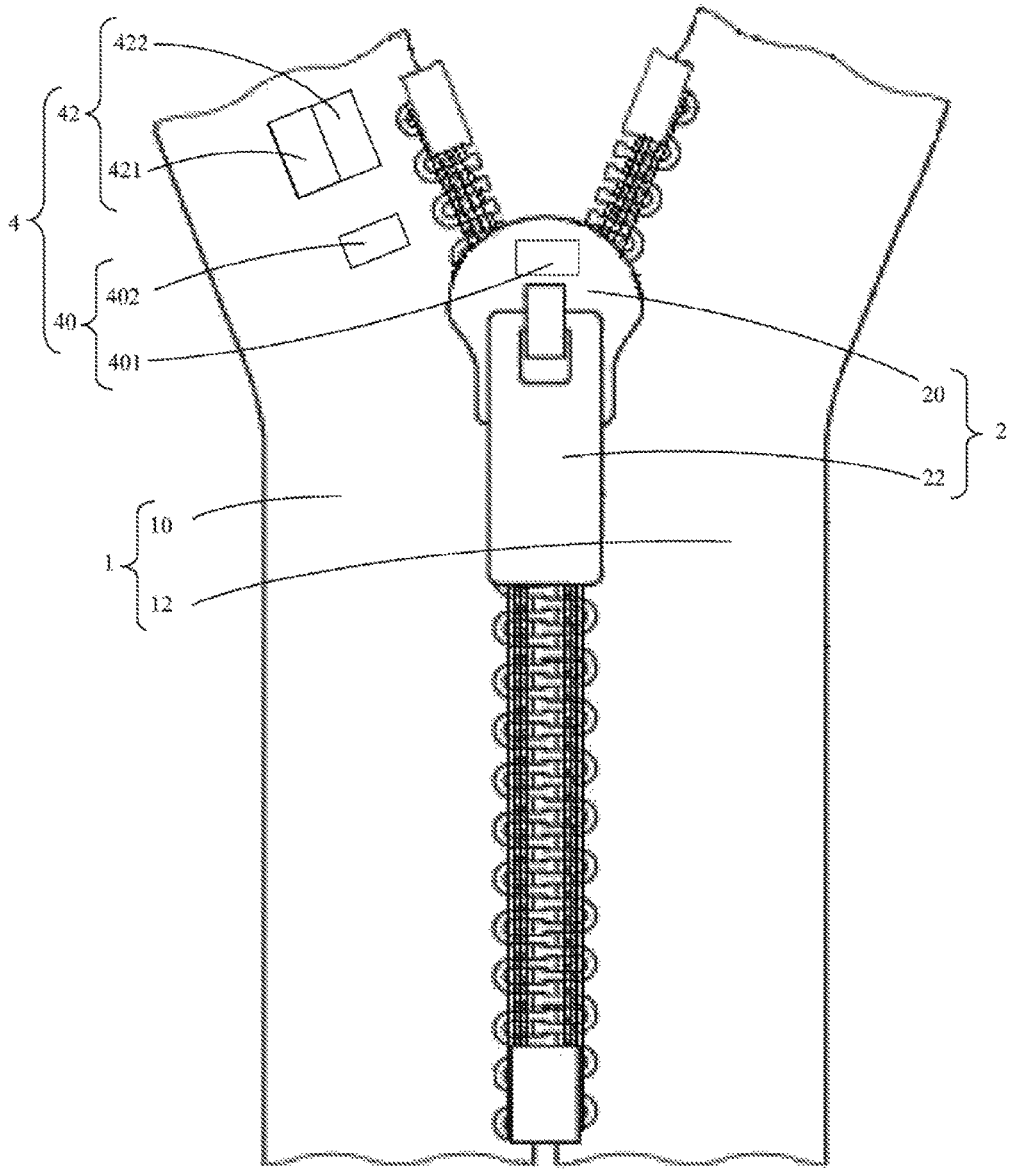
FIG. 1 is a schematic view of an intelligent anti-theft zipper of the present disclosure.

Referring to FIG. 1, the present disclosure provides an intelligent anti-theft zipper including a zipper tape 1, a zipper head 2, and an intelligent anti-theft module 4.

Wherein, the zipper tape 1 can adopts zipper structure of various traditional zippers, and the zipper head 2 includes a slider 20 and a puller 22 connected to the slider. Especially, the zipper structure with explosion-proof function can be adopted.

Figure 2:
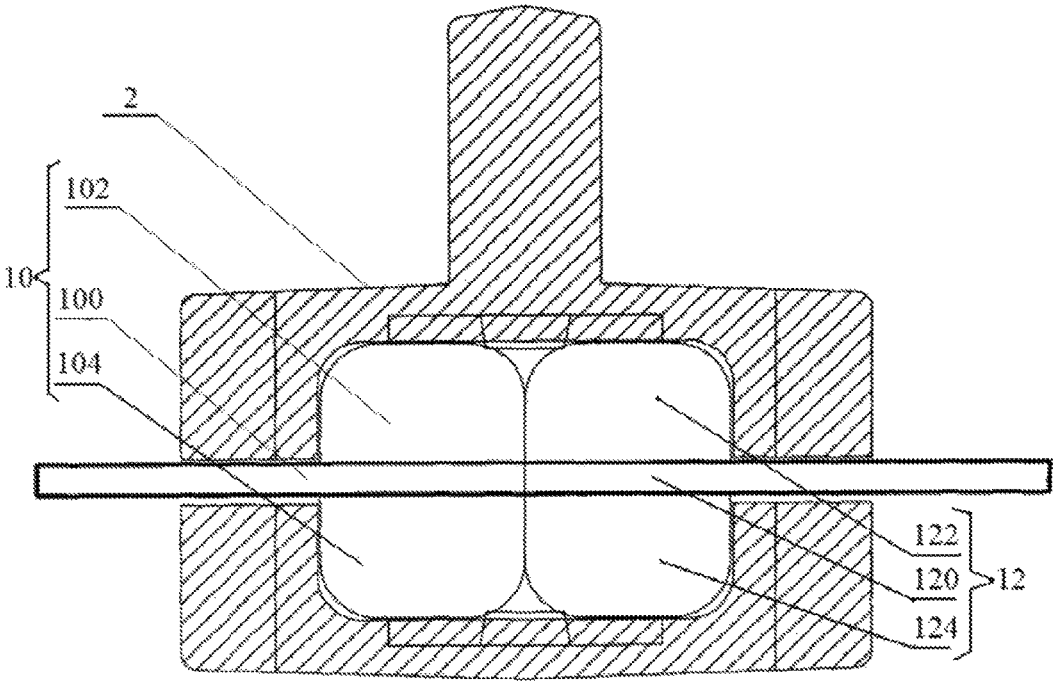
FIG. 2 is a schematic view of an embodiment of a zipper structure of the zipper of the present disclosure.

An embodiment shown in FIG. 2 adopts a zipper structure with explosion-proof function, and a zipper tape 1 of the zipper structure includes a left zipper tape 10 and a right zipper tape 12. The left zipper tape 10 includes a left tape width 100, and left upper chain teeth 102 and left lower chain teeth 104 respectively mounted to top and bottom surfaces of a right side of the left tape width 100. The right zipper tape 12 includes a right tape width 120, and right upper chain teeth 122 and right lower chain teeth 124 respectively mounted to top and bottom surfaces of a left side of the right tape width 120. The left upper chain teeth 102 cooperates with the right upper chain teeth 122, and the left lower chain teeth 104 cooperates with the right lower chain teeth 124. Correspondingly, the slider 20 of the zipper head 2 is a double-chained slider, and cooperates with the combination of the left upper chain teeth 102, the right upper chain teeth 122, the left lower chain teeth 104, and the right lower chain teeth 124.

Figure 3:
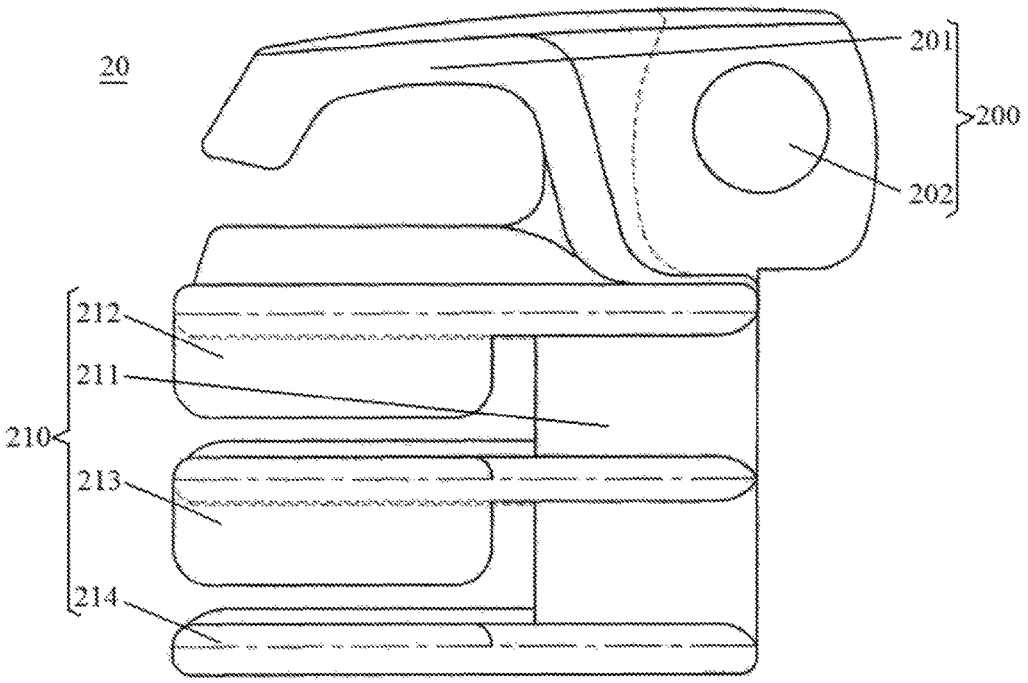
FIG. 3 is a schematic view of an embodiment of a zipper head of the zipper of the present disclosure.

Another embodiment shown in FIG. 3 adopts a double-layered zipper structure. A zipper tape (not shown) of the zipper structure includes left and right zipper tapes. The left and right zipper tapes are both double-layered. Specifically, the double-layered zipper tapes each includes a double-layered tape width, and chain teeth are correspondingly mounted to each layer of the tape width. A zipper head 2 is double-layered, and a slider 20 of the zipper head 2 includes a block 200 and a double-layered lock 210 connected to the block 200. The block 200 includes a beam 201 for mounting a puller (not shown), and a lock hole portion 202 connected to the beam 201. The double-layered lock 210 includes a pole 211, and a top plate 212, a middle plate 213, and a bottom plate 214 parallel to one another and perpendicularly mounted to the pole 211. The double-layered lock 210 cooperates with the double-layered zipper tape.

Figure 4:
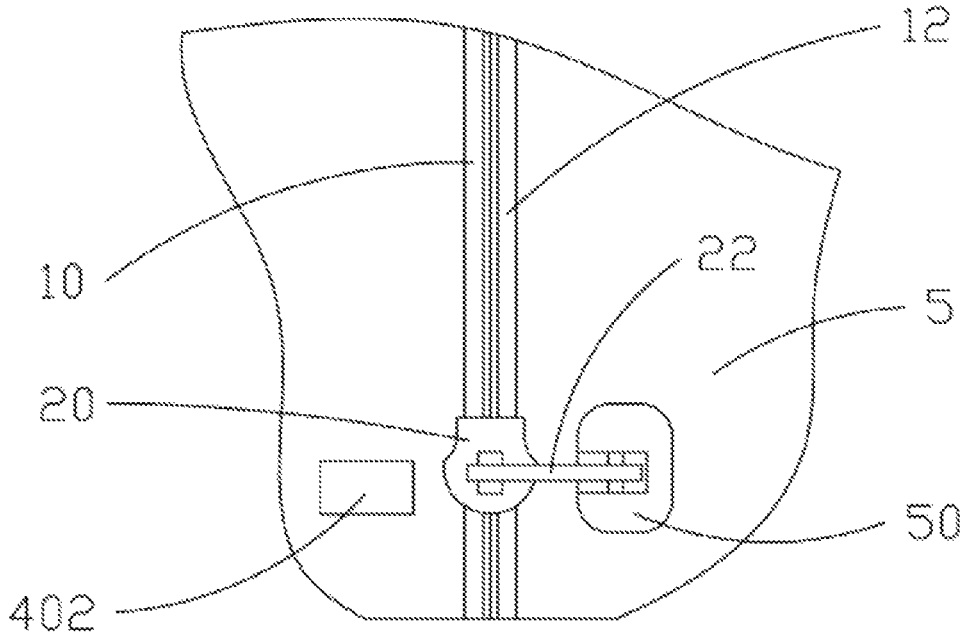
FIG. 4 is a schematic view of a second embodiment of an intelligent anti-theft zipper of the present disclosure.

The intelligent anti-theft module 4 includes a control signal switch 40, an alarm unit 42 to provide an alarm according to a control signal outputted from the control signal switch 40, and a power supply 44. The control signal switch 40 includes a first switch component 401 and a second switch component 402 cooperating with each other, wherein, the first switch component 401 is mounted to the zipper head 2. Specifically in use, the first switch component 401 can be mounted to the slider 20 or can be mounted to the puller 22, and the second switch component 402 is mounted to the zipper tape 1 or an object mounted with the zipper. An installation position of the second switch component 402 is corresponding to a position of the zipper head 2 when the zipper is completely closed. In the embodiment shown in FIG. 1, the second switch component 402 is mounted to the zipper tape 1, while in an embodiment shown in FIG. 4, the second switch component 402 is mounted to a suitcase 5 mounted with the zipper. The control signal switch 40 generates the control signal and transmits the control signal to the alarm unit 42 when the first switch component 401 deviates from the second switch component 402 for a predetermined distance. The embodiment may adopt the puller locking device 46 of the above-mentioned embodiment.

Specifically in use, the control signal switch 40 can be a proximity switch or a photo-electric switch. Therefore, the control signal switch 40 can sensitively detect a position change between the first switch component 401 and the second switch component 402, which is a distance change of the zipper head 2 corresponding to the close position of the zipper, thereby accordingly generating an alarm signal. Through selecting or adjusting the proximity switch or the photo-electric switch, the predetermined distance of the first switch component 401 deviating from the second switch component 402, which triggers the control signal switch 40 to generate the alarm signal, can be controlled in a small range, such as 1-2 centimeters. Therefore, a false alarm can be avoided when the zipper is accidentally pulled away for a small distance while items inside the cases or the bag cannot be effectively taken out.

The alarm unit 42 may be mounted to the zipper tape 1 or the object mounted with the zipper. The alarm unit 42 includes an alarm device 421 for providing an alarm. The alarm device 421 includes at least one of a buzzer, a voice alarm, and a flash alarm. In addition, the alarm unit 42 further includes a wireless communication component 422 for outputting the alarm signal to an anti-theft terminal cooperating with the alarm unit 42. The wireless communication component 422 may be any one of the following communication components which include a Bluetooth communication component, a 2.4G communication component, a GSM communication component, a GPRS communication component, and a 3G/4G/5G communication component.

The intelligent anti-theft zipper may further include a puller locking device 46 which is mounted to the object mounted with the intelligent anti-theft zipper and cooperates with the puller 22 of the zipper head 2 to lock the zipper head 2. The puller locking device 46 adopts various password-type locking devices or mechanical locking devices, and preferably adopts password-type locking devices. The zipper head 2 is locked to the puller locking device 46 through the lock hole defined in the puller 22. Furthermore, the puller locking device 46 is connected to the alarm unit 42. The puller locking device 46 outputs a pause signal to the alarm unit 42 to allow the alarm unit 42 to enter a pause mode when the puller locking device 46 is properly unlocked, and at this time, the alarm unit 42 will not provide an alarm even if the alarm unit 42 receives the control signal outputted from the control signal switch 40. The puller locking device 46 outputs a start signal to the alarm unit 42 to allow the alarm unit 42 to enter an enabled mode when the puller locking device 46 is locked, that is, the alarm unit 42 will normally provide an alarm when the alarm unit 42 receives the control signal outputted from the control signal switch 40.

Figure 5:
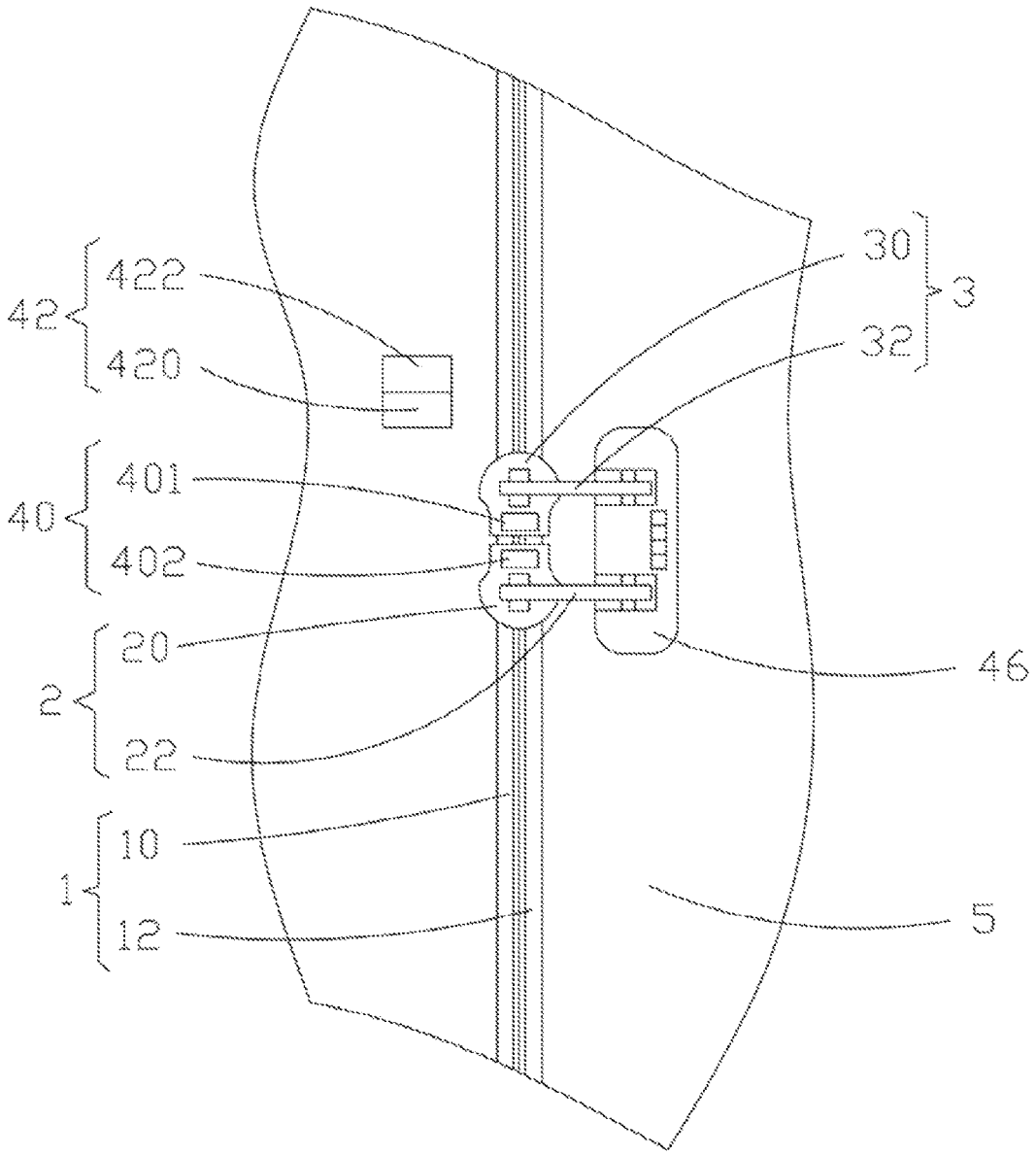
FIG. 5 is a schematic view of a third embodiment of an intelligent anti-theft zipper of the present disclosure.

Referring to FIG. 5, another embodiment of the present disclosure provides an intelligent anti-theft zipper including a zipper tape 1, a first zipper head 2 and a second zipper head 3 mounted to the zipper tape 1, and an intelligent anti-theft module 4. The intelligent anti-theft module 4 includes a control signal switch 40, an alarm unit 42 to give an alarm according to a control signal outputted from the control signal switch 40, and a power supply 44. The control signal switch 40 includes a first switch component 402 mounted to the first zipper head 2, and a second switch component 401 mounted to the second zipper head 3 and cooperating with the first switch component 402. The control signal switch 40 generates the control signal and transmits the control signal to the alarm unit 42 when the first switch component 402 deviates from the second switch component 401 for a predetermined distance.

Figure 6:
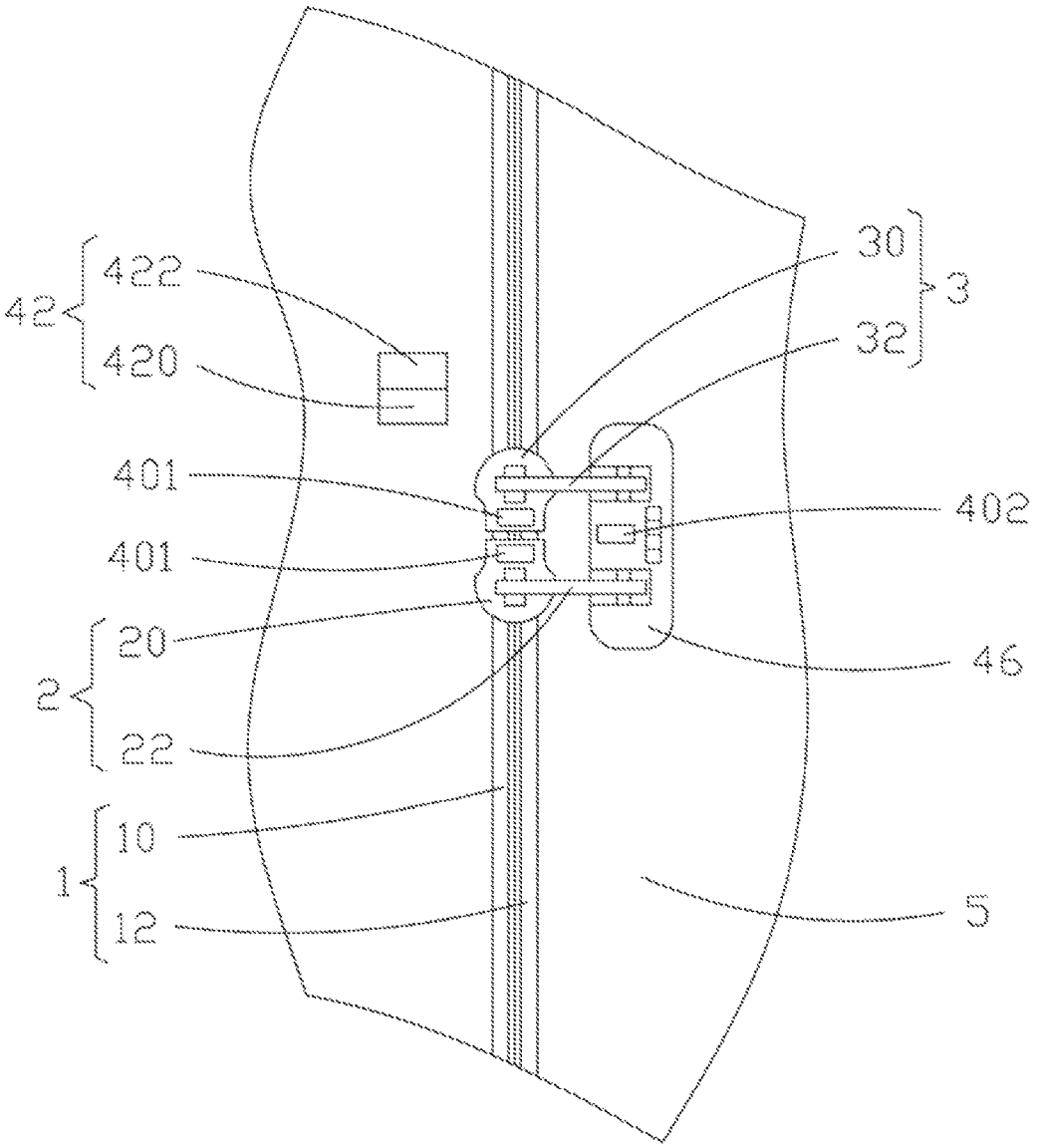
FIG. 6 is a schematic view of a fourth embodiment of an intelligent anti-theft zipper of the present disclosure.

In still another embodiment of the present disclosure, an intelligent anti-theft zipper includes at least one group of zipper tapes. At least one zipper head 2 is mounted to each group of zipper tapes. FIG. 6 shows an example of one group of zipper tapes 1 cooperating with two zipper heads 2. It is understandable, more groups of zipper tapes 1 can be set, and one or two zipper heads 2 can be mounted to each group of zipper tapes 1. A first switch component 401 is mounted to each zipper head 2. Specifically in use, the first switch component 401 may be mounted to the slider 20 or the puller 22. Only one second switch component 402 is mounted to the zipper tape 1 or the object mounted with the zipper. The zipper heads 2 are located within a predetermined safe distance from the second switch component 402 when the zipper is completely closed. Similarly, the control signal switch 40 outputs a control signal to the alarm unit 42 when the first switch component 401 is deviated from the second switch component 402 for the predetermined distance which is beyond the safe distance range.

Figure 7:
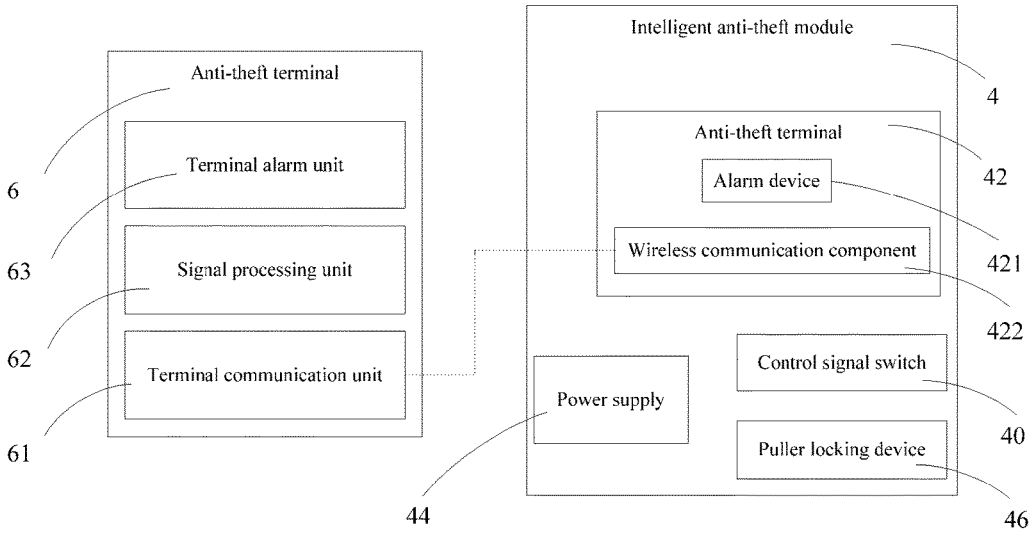
FIG. 7 is a schematic diagram of an intelligent anti-theft system for zippers of the present disclosure.

On the other hand, referring to FIG. 7, the present disclosure still further provides an intelligent anti-theft system for zippers. The intelligent anti-theft system includes an intelligent anti-theft zipper similar to the above-mentioned intelligent anti-theft zipper, and an anti-theft terminal 6. The anti-theft terminal includes a terminal communication unit 61 for communicating with the wireless communication unit 422, a signal processing unit 62, and a terminal alarm unit 63. The signal processing unit 62 receives and processes the alarm signal received by the terminal communication unit 61, and outputs an alarm command. The terminal alarm unit 63 provides an alarm according to the alarm command.

Specifically in use, the anti-theft terminal may be a smart phone, a tablet computer, or a special handheld alarm terminal. For instance, when adopting the smart phone as the anti-theft terminal, corresponding programs can be installed in the smart phone, thus, the smart phone can obtain the corresponding alarm signal. Therefore, the smart phone rings the alarm, a screen of the smart phone flashes, or the smart phone provides a voice alarm.

In one embodiment, the intelligent anti-theft zipper of the intelligent anti-theft system includes at least two groups of zipper tapes 1. Each group of zipper tapes includes at least one zipper head 2, and a first switch component 401 is mounted to each zipper head 2. The intelligent anti-theft zipper includes only one second switch component 402. The second switch component 402 cooperates with the first switch components 401 of the zipper heads 2 in an one-to-many control mode. The control signal switch 40 generates a control signal to activate the alarm unit 42 to provide an alarm when any one of the zipper heads 2 departs from the second switch component 402 for the determined distance.

It is to be understood that even though embodiments of the present disclosure have been set forth in the foregoing description, for those of ordinary skill in the art, various changes, modifications, substitutions, and variations of these embodiments may be made without departing from the principles and spirit of the present disclosure. The scope of the present disclosure is defined by the appended claims and their equivalents.

What is claimed is:

1. An intelligent anti-theft zipper, comprising:

a zipper tape;

a zipper head; and an intelligent anti-theft module, comprising:

a control signal switch;

an alarm unit for providing an alarm according to a control signal outputted from the control signal switch;

a power supply; and a puller locking device;

wherein the control signal switch comprising a first switch component and a second switch component cooperating with each other, the first switch component is mounted to the zipper head, the second switch component is mounted to the zipper tape or an object mounted with the zipper; an installation position of the second switch component corresponds to a position of the zipper head in response to the zipper being completely closed, and the control signal switch generates the control signal and transmits the control signal to the alarm unit in response to the first switch component deviating from the second switch component for a predetermined distance; and wherein the puller locking device is mounted to the object mounted with the intelligent anti-theft zipper, and cooperates with a puller of the zipper head to lock the puller; the puller locking device is connected to the alarm unit, the puller locking device outputs a pause signal to the alarm unit to allow the alarm unit to enter a pause mode in response to the puller locking device being properly unlocked, and the puller locking device outputs a start signal to the alarm unit to allow the alarm unit to enter an enabled mode in response to the puller locking device being locked.

2. The intelligent anti-theft zipper of claim 1, wherein the zipper comprises at least one group of zipper tapes and at least two zipper heads, each of the at least two zipper heads is mounted with one of the first switch component, the zipper comprises one of the second switch component, and the one of the second switch component cooperates with the first switch components of the at least two zipper heads in an one-to-many control mode.

3. The intelligent anti-theft zipper of claim 1, wherein the alarm unit comprises a wireless terminal component for outputting an alarm signal to an anti-theft terminal that cooperates with the alarm unit.

4. The intelligent anti-theft zipper of claim 3, wherein the wireless terminal component is selected from the group consisting of a Bluetooth communication component, a 2.4G communication component, a GSM communication component, a GPRS communication component, and a 3G/4G/5G communication component.

5. The intelligent anti-theft zipper of claim 1, wherein the control signal switch is a proximity switch or a photoelectric switch.

6. The intelligent anti-theft zipper of claim 1, wherein the alarm unit comprises an alarm device for providing the alarm, and the alarm device comprises at least one of a buzzer, a voice alarm, and a flash alarm.

7. The intelligent anti-theft zipper of claim 1, wherein the zipper tape comprises a left zipper tape and a right zipper tape each comprising two layers of tape widths, each of the layers of the tape widths is formed with chain teeth; the zipper head comprises a slider and a puller, the slider is double-layered, the left zipper tape comprises a left tape width, and a left upper chain teeth and a left lower chain teeth respectively mounted to top and bottom surfaces of a right side of the left tape width; the right zipper tape comprises a right tape width, and a right upper chain teeth and a right lower chain teeth respectively mounted to top and bottom surfaces of a left side of the right tape width; the left upper chain teeth cooperate with the right upper chain teeth, and the left lower chain teeth cooperate with the right lower chain teeth; the slider is a double-chained slider cooperating with a combination of the left upper chain teeth, the right upper chain teeth, the left lower chain teeth, and the right lower chain teeth.

8. The intelligent anti-theft zipper of claim 1, wherein the zipper tape comprises a left zipper tape and a right zipper tape, the left and right zipper tapes each comprises two layers of tape widths, and chain teeth are correspondingly mounted to each of the layers of the tape widths, the zipper head comprises a double-layered slider and a puller, the double-layered slider comprises a block and a double-layered lock connected to the block; the block comprises a beam for mounting the puller, and a lock hole portion connected to the beam; the double-layered lock comprises a pole, and a top plate, a middle plate, and a bottom plate parallel to one another and perpendicularly mounted to the pole.

9. An intelligent anti-theft system, comprising:

an intelligent anti-theft zipper, wherein the intelligent anti-theft zipper is the intelligent anti-theft zipper of claim 1; and an intelligent anti-theft terminal connected to the alarm unit, and comprising:

a terminal communication unit for communicating with the alarm unit;

a signal processing unit for receiving and processing the alarm signal received by the terminal communication unit and outputting an alarm command; and a terminal alarm unit for providing an alarm according to the alarm command.

10. The intelligent anti-theft system of claim 9, wherein the terminal communication unit of the anti-theft terminal is a wireless communication unit.

11. The intelligent anti-theft system of claim 9, wherein the anti-theft terminal is a smart phone, a tablet computer, or a special handheld alarm terminal.

12. An intelligent anti-theft zipper, comprising:

a zipper tape;

a first zipper head and a second zipper head mounted to the zipper tape; and an intelligent anti-theft module, comprising:

a control signal switch;

an alarm unit for providing an alarm according to a control signal outputted from the control signal switch;

a power supply and a puller locking device;

wherein the control signal switch comprising a first switch component mounted to the first zipper head, and a second switch component mounted to the second zipper head and cooperating with the first switch component, the control signal switch generates the control signal and transmits the control signal to the alarm unit in response to the first switch component deviating from the second switch component for a predetermined distance; and wherein the puller locking device is mounted to an object mounted with the intelligent anti-theft zipper, and cooperates with a puller of the zipper head to lock the puller; the puller locking device is connected to the alarm unit, the puller locking device outputs a pause signal to the alarm unit to allow the alarm unit to enter a cause mode in response to the puller locking device being properly unlocked, the puller locking device outputs a start signal to the alarm unit to allow the alarm unit to enter an enabled mode in response to the puller locking device being locked.

13. The intelligent anti-theft zipper of claim 12, wherein the alarm unit comprises a wireless terminal component for outputting an alarm signal to an anti-theft terminal cooperating with the alarm unit.

* * * * *